US010130970B2

(12) United States Patent
Groene et al.

(10) Patent No.: US 10,130,970 B2
(45) Date of Patent: Nov. 20, 2018

(54) JETTING DISPENSER, AND A METHOD FOR JETTING DROPLETS OF FLUID MATERIAL

(71) Applicant: NORDSON CORPORATION, Westlake, OH (US)

(72) Inventors: Jeff Groene, Coventry, RI (US); John D. Jones, Cranston, RI (US); Nicole Nurse, Swansea, MA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/122,183

(22) PCT Filed: Feb. 11, 2015

(86) PCT No.: PCT/US2015/015360

§ 371 (c)(1),
(2) Date: Aug. 29, 2016

(87) PCT Pub. No.: WO2015/126693

PCT Pub. Date: Aug. 27, 2015

(65) Prior Publication Data

US 2016/0368016 A1 Dec. 22, 2016

Related U.S. Application Data

(60) Provisional application No. 61/940,060, filed on Feb. 14, 2014.

(51) Int. Cl.

| | |
|---|---|
| ***B05C 5/02*** | (2006.01) |
| ***B05B 1/30*** | (2006.01) |
| ***B05C 11/10*** | (2006.01) |

(52) U.S. Cl.

CPC ..... *B05C 5/0225* (2013.01); *B05B 1/3046* (2013.01); *B05C 11/1034* (2013.01)

(58) Field of Classification Search

CPC ... B05B 1/3046; B05B 11/30; B05B 11/2001; B05B 11/3005; B05C 5/0225; B05C 11/1034

(Continued)

(56) References Cited

U.S. PATENT DOCUMENTS 2,941,726 A * 6/1960 Szczepanski ..... B05B 9/002 239/135
3,589,612 A * 6/1971 Shaffer ..... B05B 7/0876 239/139

(Continued)

FOREIGN PATENT DOCUMENTS

CN 1986075 A 6/2007
CN 101646502 A 2/2010

(Continued)

OTHER PUBLICATIONS

European Patent Application No. 15752634.4; Extended Search Report; dated Feb. 13, 2017; 6 pages.

(Continued)

*Primary Examiner* — Christopher Kim
(74) *Attorney, Agent, or Firm* — Baker & Hostetler LLP

(57) ABSTRACT

Jetting dispensers and methods for jetting droplets of fluid material are disclosed. A jetting dispenser may include a fluid module and a plunger. A fluid module includes a fluid body member having within it a fluid body bore, and a nozzle having a dispensing opening. A plunger has a distal tip end surface that opposes and is complementary to a nozzle element surface of the nozzle adapted is moveable between a retracted position spaced from the dispensing opening and a forward position proximate to but spaced from the nozzle. At least one droplet of fluid material is jetted from the dispensing opening as the plunger moves from the retracted position to the forward position. The plunger is stopped prior to contacting the nozzle, so wear is (Continued)

lessoned and fluid material containing particles may be dispensed.

11 Claims, 5 Drawing Sheets

(58) Field of Classification Search
USPC ..... 239/331–334, 456, 459
See application file for complete search history.

(56) References Cited

U.S. PATENT DOCUMENTS

| | | | | |
|---|---|---|---|---|
| 3,601,988 | A * | 8/1971 | Chermensky | B02C 19/00 222/334 |
| 9,233,388 | B2 | 1/2016 | Saidman | |
| 9,314,812 | B2 | 4/2016 | Clark et al. | |
| 9,440,781 | B2 | 9/2016 | Ikushima | |
| 2007/0145164 | A1 | 6/2007 | Ahmadi et al. | |
| 2009/0095825 | A1 | 4/2009 | Ahmadi et al. | |
| 2011/0300295 | A1 | 12/2011 | Clark et al. | |
| 2012/0312838 | A1 | 12/2012 | Clark et al. | |
| 2015/0115000 | A1 | 4/2015 | Riney et al. | |

FOREIGN PATENT DOCUMENTS

| | | | |
|---|---|---|---|
| CN | 102803123 | A | 11/2012 |
| WO | 2008/108094 | A1 | 9/2008 |
| WO | 2011/071888 | A1 | 6/2011 |
| WO | 2013/008799 | A1 | 1/2013 |

OTHER PUBLICATIONS

CN Office Action dated Jan. 25, 2018 for CN Application No. 201580008656.

* cited by examiner

JETTING DISPENSER, AND A METHOD FOR JETTING DROPLETS OF FLUID MATERIAL

CROSS-REFERENCE TO RELATED APPLICATION

This application is a U.S. National Stage of International Patent App. No. PCT/US2015/015360, filed Feb. 11, 2015, and published as International Patent App. Pub. No. WO 2015/126693 on Aug. 27, 2015, which claims priority to U.S. Provisional Patent App. No. 61/940,060, filed Feb. 14, 2014, the disclosures of which are incorporated by reference in their entirety.

FIELD OF THE INVENTION

The present invention generally relates to dispensing devices and, more particularly, to devices for jetting droplets of fluid material.

BACKGROUND

Liquid dispensers for jetting fluid materials such as solder paste, conformal coatings, encapsulants, underfill material, and surface mount adhesives, are known in the art. These dispensers generally operate to dispense small volumes of fluid material to a substrate by rapidly contacting a valve seat with a valve member to create a distinct, high pressure pulse that ejects a small volume of fluid material from the dispenser. With repeated use, however, the contact between the valve member and the valve seat can cause wear or damage to either or both of those components in a manner that alters the dispensing characteristics of the dispenser. In addition, some fluid materials can contain particles, such as non-liquid components. The particles may be crushed between the valve element and the valve seat and this can damage the particles, or the valve element and valve seat, or both.

Therefore, a need exists for improvements relating to dispensers for jetting fluid materials.

SUMMARY

Embodiments of the invention are directed to a jetting dispenser that includes a plunger for causing droplets of fluid material to be jetted out of a dispensing opening, and a method for jetting droplets of fluid material.

According to one embodiment of the invention, a jetting dispenser is provided for jetting droplets of fluid material. The jetting dispenser includes a fluid module including a fluid body member having within it a fluid body bore. The fluid module further includes a nozzle having a dispensing opening. The fluid body bore is adapted to receive the fluid material from a fluid supply. The jetting dispenser further includes a plunger having a distal tip end surface that opposes and is generally complementary to a nozzle element surface of the nozzle adapted to cause at least one droplet of fluid material to be jetted out of the dispensing opening. The plunger is moveable between a retracted position spaced from the dispensing opening and a forward position proximate to but spaced from the nozzle. At least one droplet of the fluid material is jetted from the dispensing opening as the plunger moves from the retracted position to the forward position.

According to another embodiment of the invention, a method is provided for jetting droplets of fluid material from a jetting dispenser. The jetting dispenser has a fluid module including a fluid body member having within it a fluid body bore containing fluid material, and a nozzle having a dispensing opening. The method includes moving a plunger having a distal tip end surface that opposes and is generally complementary to a nozzle element surface of the nozzle in the fluid body bore toward the dispensing opening. The method further includes jetting at least one droplet of the fluid material from the fluid body bore out of the dispensing opening during movement of the plunger toward the dispensing opening. The method further includes stopping the plunger before the plunger contacts the nozzle. The method further includes subsequently filling the fluid body bore with the fluid material while moving the plunger in the fluid body bore away from the dispensing opening.

According to another embodiment of the invention, a method is provided for jetting droplets of fluid material from a jetting dispenser having a fluid module including a fluid body member having within it a fluid body bore containing fluid material, and a nozzle having a dispensing opening. The method includes moving a plunger having a distal tip end surface that opposes and is generally complementary to a nozzle element surface of the nozzle in the fluid body bore toward the dispensing opening using a first mechanism. The method further includes jetting at least one droplet of the fluid material from the fluid body bore out of the dispensing opening during movement of the plunger toward the dispensing opening. The method further includes stopping the plunger before the plunger contacts the nozzle using a stop mechanism. The method further includes subsequently beginning to fill the fluid body bore with the fluid material while beginning to move the plunger in the fluid body bore away from the dispensing opening.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
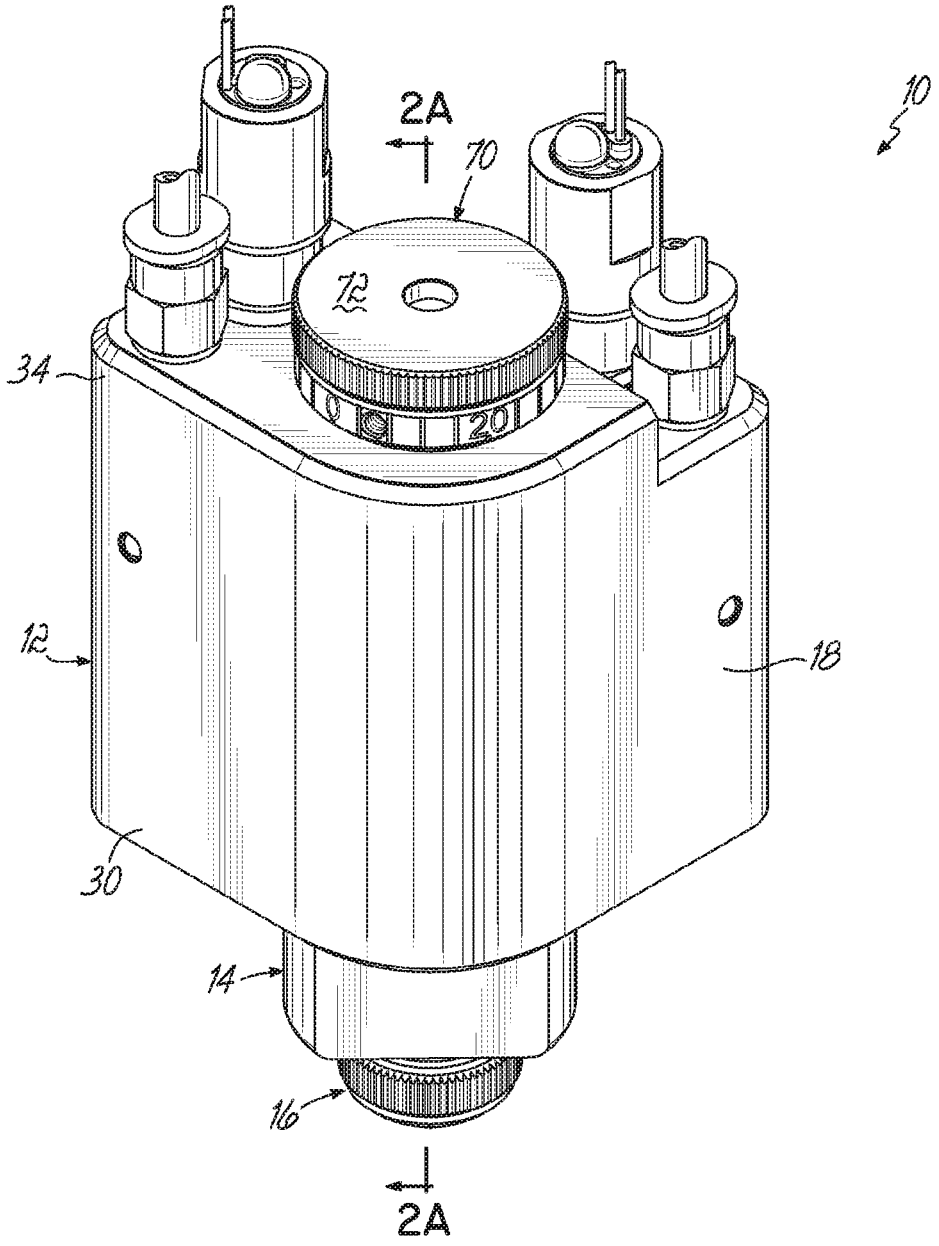
FIG. 1 is an isometric view showing a jetting dispenser according to an embodiment of the present invention.

Referring to the figures, a jetting dispenser 10 generally includes an actuation module 12 and a fluid module 14. The jetting dispenser 10 is adapted to dispense, or jet, droplets of fluid material out of a nozzle 16 of the fluid module 14.

The actuation module 12 includes an actuation body member 18 that has within it an actuation body bore 20. In particular, the actuation body member 18 includes a first inner wall 22, and a step 24 that extends radially inwardly from the first inner wall 22. The first inner wall 22 extends generally along an axial direction of the actuation body member 18. As shown, the first inner wall 22 and the step 24 are generally perpendicular to each other.

The actuation body member 18 further includes a second inner wall 26 extending generally along an axial direction of the actuation body member 18. The space inside the second inner wall 26 forms a socket 28, which is located in a base portion 30 of the actuation body member 18. A passageway 29 connects the actuation body bore 20 and the socket 28. The actuation body bore 20, the passageway 29, and the socket 28 are all generally co-axial. A cap 32 is positioned at an upper portion 34 of the actuation body member 18 and forms an end of the actuation body bore 20.

The fluid module 14 includes a fluid body member 36 that has within it a fluid body bore 38. In particular, the fluid body member 36 includes an inner wall 40, and the fluid body bore 38 is generally inside the inner wall 40. The inner wall 40 extends generally along an axial direction of the fluid body member 36. The fluid body member 36 includes, or is coupled with, the nozzle 16, at a base portion 42 of the fluid body member 36.

Figure 3A:
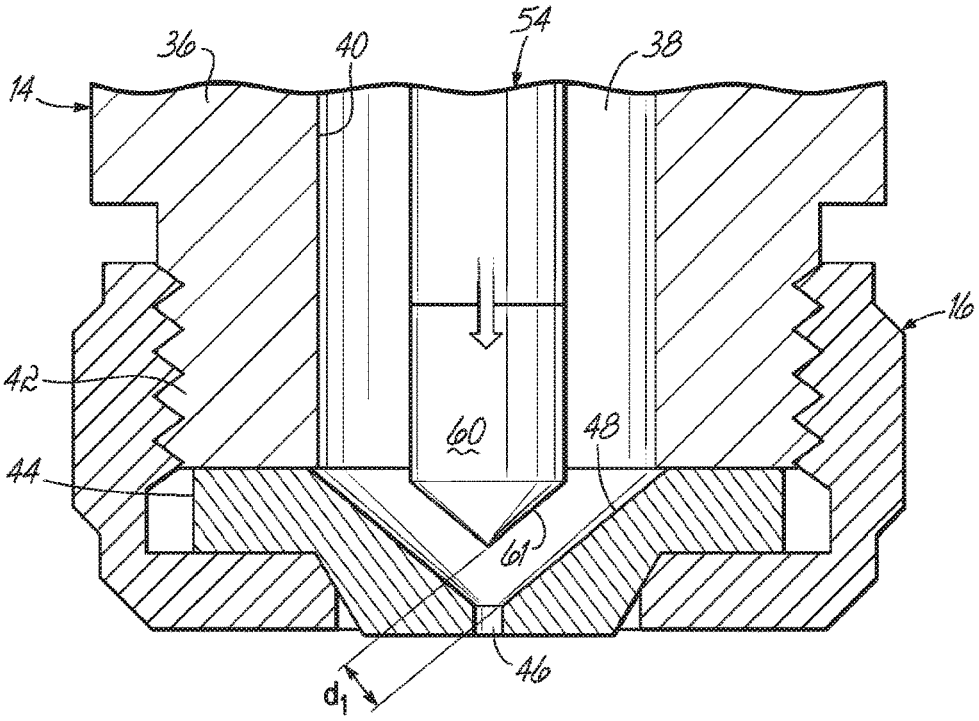
FIG. 3A is an enlarged view of FIG. 2A and showing the tip of the plunger spaced from a nozzle element when the plunger is in the retracted position.
Figure 3B:
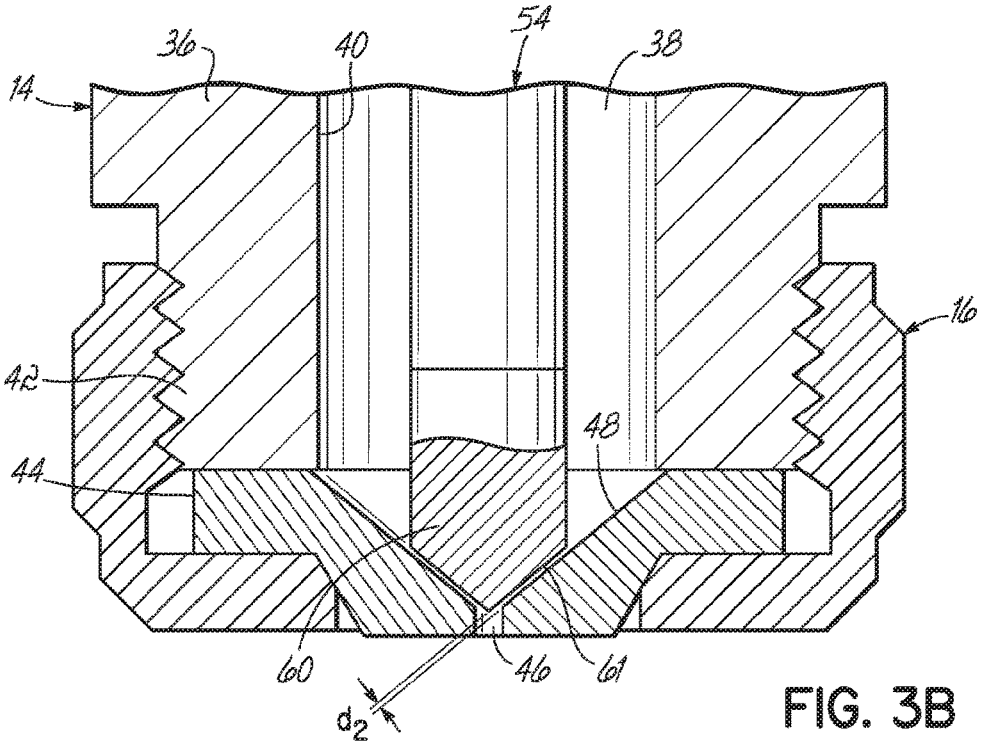
FIG. 3B is an enlarged view of FIG. 2B and showing the tip proximate to, but spaced from, the nozzle element when the plunger is in the forward position.
Figure 3C:
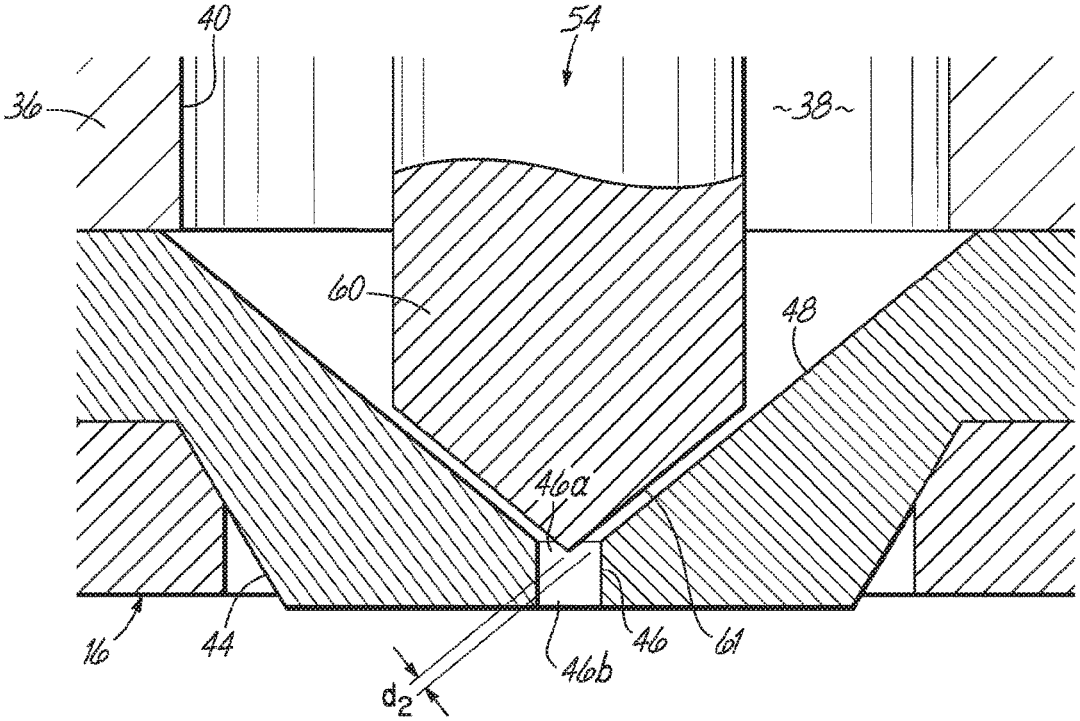
FIG. 3C is an enlarged view of FIG. 3B showing the spacing between a distal tip end surface of the tip and a nozzle element surface of the nozzle element when the plunger is in the forward position.

The nozzle 16 includes a nozzle element 44 that faces the fluid body bore 38, and a dispensing opening 46. The dispensing opening 46 extends through the nozzle element 44 generally along an axial direction of the fluid body member 36. The nozzle element 44 includes a nozzle element surface 48 which is sloped and extends radially inwardly between the inner wall 40 and the dispensing opening 46. The dispensing opening 46 generally extends along a length between an upstream end 46*a* and a downstream end 46*b*. The upstream end 46*a* is generally proximate the nozzle element surface 48, and the downstream end 46*b* is generally proximate the exterior of the nozzle 16 (FIG. 3C).

A passageway 49 extends upwardly from the fluid body bore 38 to an opening 50 in an upper portion 51 of the fluid body member 36. A seal member 52 is shown in the upper portion 51. As shown, the passageway 49, the fluid body bore 38, and the dispensing opening 46 are all generally co-axial.

The fluid module 14 is operatively connected with a fluid supply 53 that supplies fluid material to the fluid body bore 38 for dispensing through the dispensing opening 46. For example, fluid material may be provided under pressure from the fluid supply 53 into the fluid body bore 38. The jetting dispenser 10 is operable to dispense a wide variety of fluid materials. Suitable fluid materials include, but are not limited to, biologicals, solder paste, braze paste, silver epoxy, and other particle containing fluids (such as fluids used to manufacture LED materials).

As shown, the fluid module 14 is partially received within the actuation module 12. In particular, the fluid body member 36 of the fluid module 14 is partially received within the socket 28 formed in the actuation body member 18 of the actuation module 12. In this configuration, the actuation body bore 20, the fluid body bore 38, and the dispensing opening 46 are all generally co-axial.

The jetting dispenser 10 further includes a plunger 54 for causing droplets of fluid material to be jetted from the fluid module 14. In the embodiment shown, the plunger 54 includes a piston assembly 56, a stem 58, and a tip 60. The piston assembly 56 has a generally plate-like construction and includes an upper surface 62 and a lower surface 64. The stem 58 is connected with the piston assembly 56 and extends along an axial direction that is generally perpendicular to the upper surface 62 and the lower surface 64 of the piston assembly 56. The stem 58 terminates at the tip 60 generally opposite the piston assembly 56, and in the embodiment shown, the tip 60 is tapered. The distance between the piston assembly 56 and the tip 60 is fixed. The tip 60 includes a distal tip end surface 61 having a shape that is generally complementary to the shape of the nozzle element surface 48. In the embodiment shown, the distal tip end surface 61 has a convex and conical shape, while the nozzle element surface 48 has a concave and frustoconical shape.

The plunger 54 is operatively associated with the actuation module 12 and the fluid module 14 as follows. The piston assembly 56 is positioned in the actuation body bore 20 of the actuation module 12. The stem 58 extends downwardly through the passageway 29, past the seal member 52, through the passageway 49, and into the fluid body bore 38 such that the tip 60 is positioned in the fluid body bore 38. In particular, the tip 60 and its distal tip end surface 61 generally face the nozzle element 44, including its nozzle element surface 48, and the dispensing opening 46. As shown, the stem 58 is generally co-axial with the actuation body bore 20, the fluid body bore 38, and the dispensing opening 46.

The plunger 54 is adapted to be moved in an axial direction away from and toward the nozzle element 44 and the dispensing opening 46. Particularly, during such movement, the piston assembly 56 moves axially within the actuation body bore 20. Also during such movement, the tip 60 moves axially within the fluid body bore 38 away from and toward the nozzle element 44 and the dispensing opening 46.

The actuation module 12 is operatively associated with an actuation device 63 adapted to move the plunger 54. The actuation device 63 generally includes a first mechanism adapted to move the plunger 54 away from the nozzle element 44 and the dispensing opening 46, and a second mechanism adapted to move the plunger 54 toward the nozzle element 44 and the dispensing opening 46. In the embodiment shown, the first mechanism is a pneumatic system 66, and the second mechanism is a spring 68 that is interposed between the cap 32 and the upper surface 62 of the piston assembly 56. However, a different actuation device 63 may be utilized, such as an electro-mechanical actuation device, so long as it provides sufficient force and velocity to move the plunger 54. As shown, the pneumatic system 66 uses air pressure to move the plunger 54 upwardly, such as by introducing positive air pressure beneath the piston assembly 56. When the plunger 54 is moved upwardly away from the nozzle element 44 and the dispensing opening 46 by the pneumatic system 66, the piston assembly 56 bears against and compresses the spring 68. When it is time to move the plunger 54 downwardly toward the nozzle element 44 and the dispensing opening 46, the pneumatic system 66 ceases to apply air pressure to the plunger 54, and the spring 68 bears against the piston assembly 56 causing the plunger 54 to move downwardly toward the nozzle element 44 and the dispensing opening 46.

The actuation module 12 may include a stroke adjustment mechanism 70 adapted to limit the extent of travel of the plunger 54. As shown, the stroke adjustment mechanism 70 includes an adjustable knob 72 associated with the cap 32.

The cap 32 includes a post 74 operatively coupled with the knob 72 and extending downwardly into the actuation body bore 20. The post 74 includes an end 76, which presents a stop surface above which the piston assembly 56, and therefore the plunger 54, cannot move. Adjustment of the knob 72 can be made to selectively move the end 76 of the post 74 axially downwardly toward the base portion 30 of the actuation body member 18, or axially upwardly toward the upper portion 34 of the actuation body member 18. Thereby, movement of the plunger 54 can be confined to the space in the actuation body bore 20 axially below the end 76 of the post 74.

The jetting dispenser 10 further includes a stop mechanism for stopping the movement of the plunger as the plunger moves toward the nozzle element 44 and the dispensing opening 46. In particular, the stop mechanism operates to stop the plunger before the plunger contacts the nozzle element 44 of the nozzle 16.

In the embodiment shown, the stop mechanism is provided by the interaction between the piston assembly 56 and the step 24 of the actuation body member 18. However, the stop mechanism may instead be any structure capable of stopping the downward movement of the plunger 54. As shown, the piston assembly 56 fits in the actuation body bore 20. The step 24 presents a stop surface, below which the piston assembly 56 cannot move. In particular, downward movement of the plunger 54 is stopped when the lower surface 64 of the piston assembly 56 contacts the step 24.

Figure 2A:
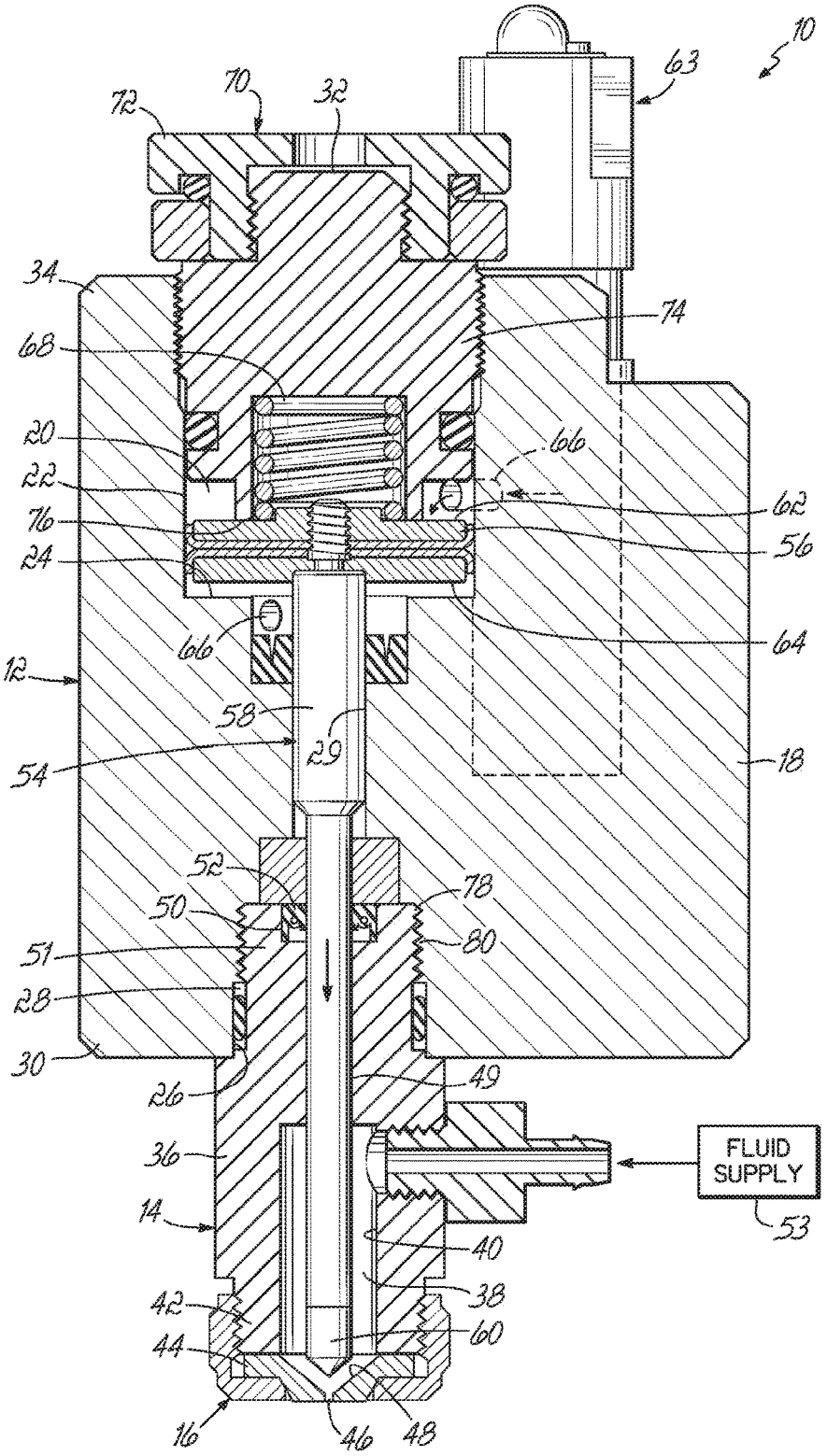
FIG. 2A is a cross-sectional view taken along line 2A-2A in FIG. 1 and showing a plunger of the jetting dispenser in a retracted position.

The plunger 54 is thereby moveable between a first, or retracted, position, and a second, or forward, position. In the retracted position (FIGS. 2A and 3A), the tip 60 is spaced from the nozzle element 44 and the dispensing opening 46. For example, the distal tip end surface 61 of the tip 60 may be spaced from the nozzle element surface 48 of the nozzle element 44 by a distance $d_1$ of approximately 0.05 inches when the plunger 54 is in the retracted position.

Figure 2B:
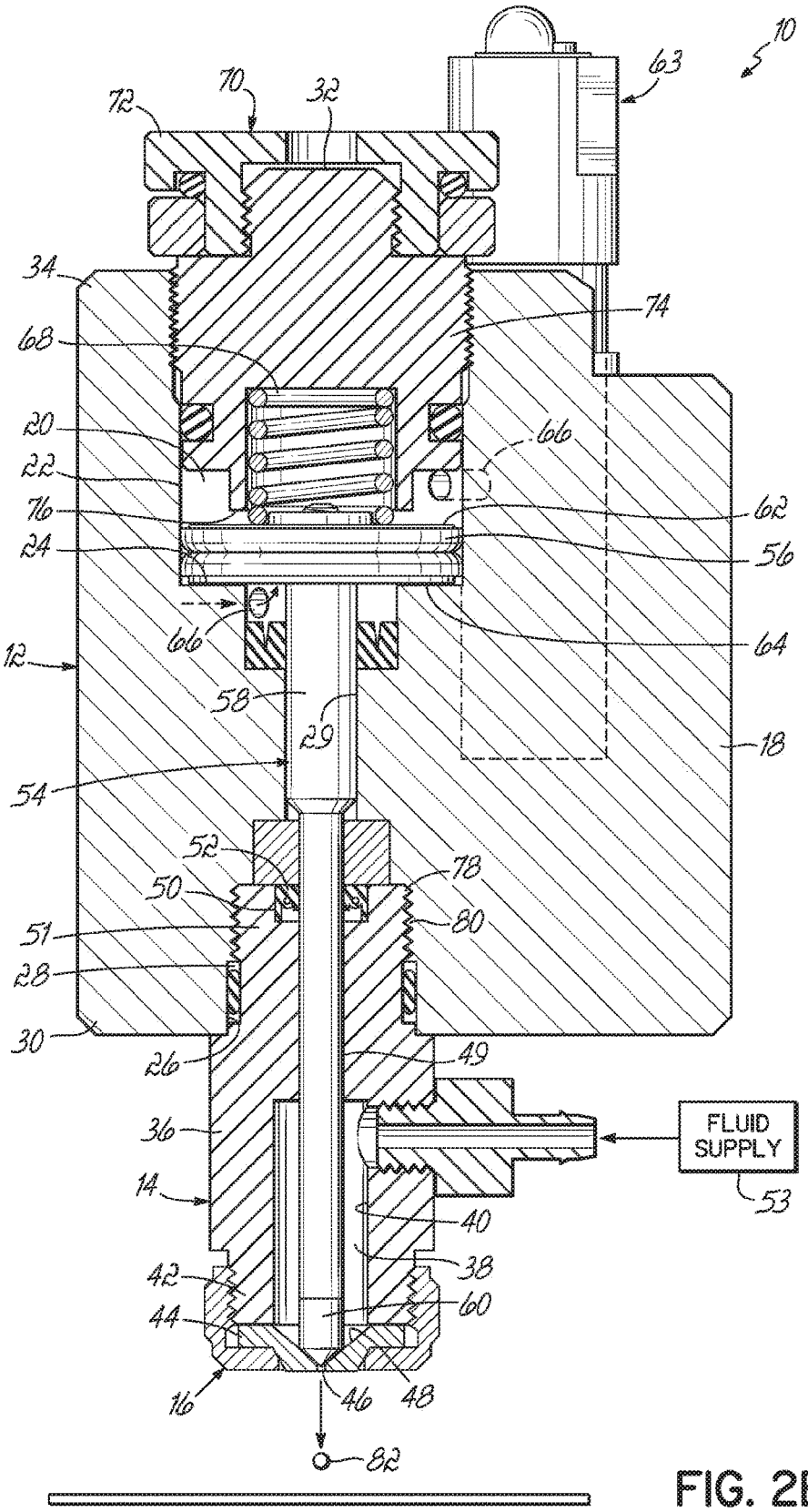
FIG. 2B is a cross-sectional view like FIG. 2A, but showing the plunger in a forward position.

In the forward position (FIGS. 2B, 3B, and 3C), the tip 60 is proximate to, but spaced from, the nozzle element 44, and more particularly, the distal tip end surface 61 is proximate to, but spaced from, the nozzle element surface 48. The piston assembly 56 contacts the step 24 when the plunger 54 is in the forward position. When the plunger 54 is in the forward position, the tip 60 is spaced from the nozzle element surface 48 of the nozzle element 44. For example, the distal tip end surface 61 of the tip 60 may be spaced from the nozzle element surface 48 by a distance $d_2$ of approximately 0.002 inches when the plunger 54 is stopped at the end of its forward movement or stroke, i.e., at the forward position. Distance $d_2$ may vary based at least upon the fluid material and presence of particles within the fluid material. For example, distance $d_2$ may need to be adjusted due to the viscosity of the fluid material to obtain optimal jetting.

The distance between the step 24 and the nozzle 16 may be adjusted. In the embodiment shown, the fluid body member 36 includes an exterior threaded portion 78 that threadably engages an interior threaded portion 80 included on the second inner wall 26 of the actuation body member 18. The fluid body member 36 is coupled with the actuation body member 18 through the threaded engagement of the threaded portions 78, 80. The position of the fluid body member 36 in the socket 28 may be adjusted by rotating the fluid body member 36 to move it axially upwardly or axially downwardly. By adjusting the distance between the step 24 and the nozzle 16, the spacing may be adjusted between the distal tip end surface 61 of the tip 60 and the nozzle element surface 48 when the plunger 54 is in the forward position.

The jetting dispenser 10 is used to jet droplets of fluid material as follows. Fluid material is provided to the fluid module 14 from the fluid supply 53. In particular, fluid material enters and fills the fluid body bore 38, surrounding the tip 60 and the portion of the stem 58 that is positioned in the fluid body bore 38. The actuation device 63 is operated to move the plunger 54. In particular, the pneumatic system 66 applies air pressure to move the plunger 54 upwardly toward the retracted position. As the plunger 54 moves toward the retracted position, a portion of the stem 58 is removed from the fluid body bore 38. Fluid material fills the space previously occupied by that portion of the stem 58, thereby occupying the region between the tip 60 and the dispensing opening 46. Fluid material may immediately begin to enter the fluid body bore 38 as the stem 58 begins to be removed from the fluid body bore 38. The speed and force at which the plunger 54 moves may be application specific. The specific geometry of the tip 60 and nozzle element 44 may be also application specific. Optionally, the location of the retracted position may be adjusted using the stroke adjustment mechanism 70.

After the plunger 54 reaches the retracted position, the pneumatic system 66 ceases to apply air pressure to the plunger 54, and the spring 68 moves the plunger 54 toward the forward position. As the plunger 54 moves toward the forward position, the portion of the stem 58 that had previously been removed from the fluid body bore 38 is reintroduced into the fluid body bore 38. This reduces the amount of space available for fluid material in the fluid body bore 38, thereby encouraging a portion of the fluid material to enter, and ultimately be expelled from, the dispensing opening 46 as jetted droplets of the fluid material. The plunger 54 is moved toward the forward position until a stop mechanism stops the forward movement of the plunger 54 at the forward position. In the illustrated embodiment, the stop mechanism comprises the piston assembly 56 engaging the step 24. Forward movement of the plunger 54 is stopped before the tip 60 contacts or touches any part of the nozzle 16, including the nozzle element 44, as best shown in FIGS. 3B and 3C. In particular, forward movement of the plunger 54 is stopped such that the distal tip end surface 61 of the tip 60 is proximate to, but spaced from, the nozzle element surface 48 of the nozzle element 44. Optionally, the distance between the step 24 and the nozzle 16 may be adjusted to change the spacing between the distal tip end surface 61 of the tip 60 and the nozzle element surface 48 of the nozzle element 44 when the plunger 54 is in the forward.

One or more droplets 82 of fluid material may thereby be jetted from the dispensing opening 46 each time the plunger 54 is moved from the retracted position to the forward position. The above process of moving the plunger 54 away from and toward the dispensing opening 46 may be repeated to jet multiple droplets of fluid material.

Advantageously, the jetting dispenser 10 can be used to jet droplets of fluid material and the stop mechanism prevents the plunger 54 from contacting the nozzle element 44. Thereby, the jetting dispenser 10 can be used without the plunger 54 and nozzle element 44 wearing in a manner that alters the dispensing characteristics of the jetting dispenser 10. Moreover, because the plunger 54 does not contact the nozzle element 44, particles which may be contained in the fluid material are not crushed in a manner that is detrimental to the particles or that damages the plunger 54 or the nozzle element 44.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A jetting dispenser for jetting droplets of fluid material, the jetting dispenser comprising:

an actuation module including an actuation body member that defines an actuation body bore that includes a step;

a fluid module including:

a fluid body member connected to the actuation body member, the fluid body member having within it a fluid body bore for receiving the fluid material from a fluid supply; and a nozzle connected to the fluid body member, wherein the nozzle defines a dispensing opening and partially defines the fluid body bore; and a plunger that includes a piston assembly, wherein the piston assembly includes at least one plate that defines a planar lower surface and is positioned in the actuation body bore, and a stem that extends from the piston assembly to a distal tip end surface, wherein the distal tip end surface opposes and is complementary to a nozzle element surface of the nozzle, and the plunger is adapted to cause at least one droplet of fluid material to be jetted out of the dispensing opening, wherein the plunger is moveable between 1) a retracted position where the plunger is spaced from the dispensing opening and 2) a forward-most position where an entirety of the plunger is spaced from the nozzle and the planar lower surface of the at least one plate of the piston assembly directly contacts the step in the forward-most position, wherein the at least one droplet of the fluid material is jetted from the dispensing opening as the plunger moves from the retracted position to the forward-most position.

2. The jetting dispenser of claim 1, further comprising:

a stroke adjustment mechanism adapted to adjust the distance the plunger moves between the retracted position and the forward-most position.

3. The jetting dispenser of claim 1, wherein the distal tip end surface has a convex shape, while the nozzle element surface has a concave shape.

4. The jetting dispenser of claim 1, wherein the fluid body bore begins to fill with the fluid material as the plunger begins to move in the fluid body bore away from the dispensing opening.

5. The jetting dispenser of claim 1, further comprising a spring that contacts an upper surface of the piston assembly, wherein the spring is configured to move the plunger from the retracted position to the forward-most position.

6. The jetting dispenser of claim 1, further comprising a pneumatic system configured to move the plunger from the forward-most position to the retracted position.

7. The jetting dispenser of claim 1, wherein the distal tip end surface has a conical shape, and the nozzle element surface has a frustoconical shape.

8. A method for jetting droplets of fluid material from a jetting dispenser having an actuation body member that defines an actuation body bore that includes a step, a fluid module including a fluid body member having within it a fluid body bore containing fluid material, and a nozzle defining a dispensing opening and partially defining the fluid body bore, the method comprising:

moving a plunger in the fluid body bore toward the dispensing opening, wherein the plunger includes a piston assembly having at least one plate that defines a planar lower surface and is positioned in the actuation body bore, and a stem that extends from the piston assembly to a distal tip end surface that opposes and is complementary to a nozzle element surface of the nozzle;

jetting at least one droplet of the fluid material from the fluid body bore out of the dispensing opening during movement of the plunger toward the dispensing opening;

stopping the plunger before any portion of the plunger contacts the nozzle when the planar lower surface of the at least one plate of the piston assembly directly contacts the step of the actuation body member; and subsequently filling the fluid body bore with the fluid material while moving the plunger in the fluid body bore away from the dispensing opening.

9. The method of claim 8, wherein the moving the plunger includes a spring bearing against the piston assembly to move the plunger towards the dispensing opening.

10. The method of claim 8, further comprising moving the plunger away from the dispensing opening via a pneumatic system configured to apply air pressure to the piston assembly.

11. The method of claim 8, wherein the distal tip end surface has a conical shape, and the nozzle element surface has a frustoconical shape.

* * * * *